US007407514B2

(12) United States Patent
Li et al.

(10) Patent No.: US 7,407,514 B2
(45) Date of Patent: Aug. 5, 2008

(54) PROCESSING TECHNIQUES FOR PREPARING MOISTURE MANAGEMENT TEXTILES

(75) Inventors: Yi Li, Kowloon (CN); Qing Wen Song, Kowloon (CN); Jun Yan Hu, Kowloon (CN)

(73) Assignee: Hong Kong Polytechnic University, Kowloon, Hong Kong (CN)

( * ) Notice: Subject to any disclaimer, the term of this patent is extended or adjusted under 35 U.S.C. 154(b) by 417 days.

(21) Appl. No.: 11/050,509

(22) Filed: Feb. 3, 2005

(65) Prior Publication Data

US 2005/0188470 A1 Sep. 1, 2005

Related U.S. Application Data

(60) Provisional application No. 60/541,444, filed on Feb. 3, 2004.

(51) Int. Cl.

| | |
|---|---|
| ***D06M 11/38*** | (2006.01) |
| ***D06M 11/57*** | (2006.01) |
| ***D06M 11/68*** | (2006.01) |
| ***D06M 11/77*** | (2006.01) |
| ***D06M 11/79*** | (2006.01) |

(52) U.S. Cl. ..... 8/115.51; 8/115.6

(58) Field of Classification Search ..... 8/115.6, 8/115.51

See application file for complete search history.

(56) References Cited

U.S. PATENT DOCUMENTS

2002/0064639 A1 * 5/2002 Rearick et al. ..... 428/292.1

* cited by examiner

*Primary Examiner*—Lorna M. Douyon
*Assistant Examiner*—Amina Khan
(74) *Attorney, Agent, or Firm*—Alix, Yale & Ristas, LLP

(57) ABSTRACT

An integrated processing technique for preparing moisture management textiles or fabrics wherein fibers are treated with compositions which impart a hydrophobic or hydrophilic property such that when incorporated into the fabrication of composite structured textiles or fabrics a hydrophobic inner surface and a hydrophilic outer surface are formed. The integrated processing technique for preparing moisture management textiles also includes finishing the textiles or fabrics to enhance the fabric's liquid water one way transfer properties. The advantage of this invention is the possibility to manufacture the pure cotton woven/knit fabrics with the good moisture management properties.

16 Claims, 7 Drawing Sheets

| | Top Surface | Bottom Surface |
|---|---|---|
| Wetting time (sec) | 5.07 | 3.635 |
| Max absorption rate (%/sec) | 24.581 | 47.2242 |
| Max wetted radius (mm) | 15.0 | 25.0 |
| Spreading Speed (mm/sec) | 0.7011 | 0.6027 |
| One way transport capability | 130.7252 | |
| Description | MMT- | |

| | Top Surface | Bottom Surface |
|---|---|---|
| Wetting time (sec) | 119.954 | 2.754 |
| Max absorption rate (%/sec) | 2.1209 | 41.9626 |
| Max wetted radius (mm) | 0.0 | 15.0 |
| Spreading Speed (mm/sec) | 0.0 | 1.0331 |
| One way transport capability | 164.6499 | |
| Description | MMT- | |

PROCESSING TECHNIQUES FOR PREPARING MOISTURE MANAGEMENT TEXTILES

CROSS-REFERENCE TO RELATED APPLICATION

This application claims the priority of U.S. Provisional Application No. 60/541,444 filed Feb. 3, 2004.

FIELD OF THE INVENTION

This invention relates to the treatment of fabrics and textiles, in particular, to processing techniques for modifying fibers, fabrics and textiles such that they are imparted with desirable moisture management characteristics.

BACKGROUND OF THE INVENTION

Multi-dimensional moisture transfer in fibers, textiles, and fabrics is commonly known as the moisture management property. Moisture management in clothing fabric typically refers to the transport of both moisture vapor and liquid away from the body of the clothing wearer. Many researchers consider the moisture management property of a fabric to be a major contributing factor to the perceived comfort a wearer of clothing experiences. For instance, during intense physical exercise an individual's perspiration rate may increase dramatically over the resting rate. Excreted perspiration in the form of liquid and vapor is transferred to those clothing surfaces in close proximity to the individual's skin. Liquid sweat and condensed vapor are desirably absorbed by the clothing fabric and transferred from the fabric's inner surface to the fabric's outer surface. At the outer surface the moisture is evaporated into the surrounding environment and/or is accumulated on the outer surface of the fabric. Fabrics possessing desirable moisture management properties impart a dry feeling to the wearer and are extremely desirable for the manufacture of casual wear, sportswear, or personal protective clothing.

Historically, cotton has been widely used in the manufacture of clothing due to cotton's low cost and extremely comfortable wear properties. However, cotton because of its generally poor moisture management characteristics has not been utilized to the extent it could be.

Conventionally, several attempts have been made to make textiles and fabrics with desirable moisture transport properties. For instance, several attempts have been disclosed in U.S. Pat. Nos. 6,509,285, 6,432,504, 6,427,493, 6,341,505, 6,277,469, 5,315,717, 5,735,145, 4,411,660,and 0,064,639 A1. Some of these attempts, U.S. Pat. Nos. 6,509,285, 6,432,504, and 6,427,493, utilize synthetic fiber to construct fabrics via conventional methods of knitting. Other conventional attempts utilize a cellulose substrate produced via fiber chemical process and non-woven manufacturing processes, as exemplified in U.S. Pat. No. 0,064,639 A1. However, all these conventional routes have utilized either a multi-layer structure design, U.S. Pat. Nos. 6,277,469 , 5,315,717, 4,411,660, or used fabrics with moisture management properties, such as in U.S. Pat. No. 5,269,720 "Moisture Managing Brassiere", U.S. Pat. No. 5,291,617 "Moisture Management Garment", and U.S. patent application Ser. No. 09/759,241, "Composite Textile Material". U.S. patent application Ser. No. 09/759,241 additionally discloses a composite structure with different distributions of hydrophobic or hydrophilic points/areas on the two surfaces.

Conventionally, there does not exist an integrated process of producing textiles or fabrics with a desired moisture management property.

SUMMARY OF THE INVENTION

Briefly stated, the present invention in a preferred form is generally directed toward an integrated processing technique for the manufacture of textiles and fabrics employing systematic fiber treatment techniques, fabrication techniques producing a textile or fabric having a composite structure, and functional treatments of the textiles or fabric to enhance one way liquid transfer properties.

An object of the invention is to manufacture pure cotton woven/knit textiles and fabrics having desirable moisture management properties.

Another object of the invention is to produce woven/knit textiles and fabrics having a variety of moisture management functional structures associated with surfaces of the woven/knit textiles and fabrics.

BRIEF DESCRIPTION OF THE DRAWINGS

Other objects and advantages of the invention will be evident to one of ordinary skill in the art from the following detailed description with reference to the accompanying drawings, in which.

DETAILED DESCRIPTION OF THE INVENTION

Figure 1:
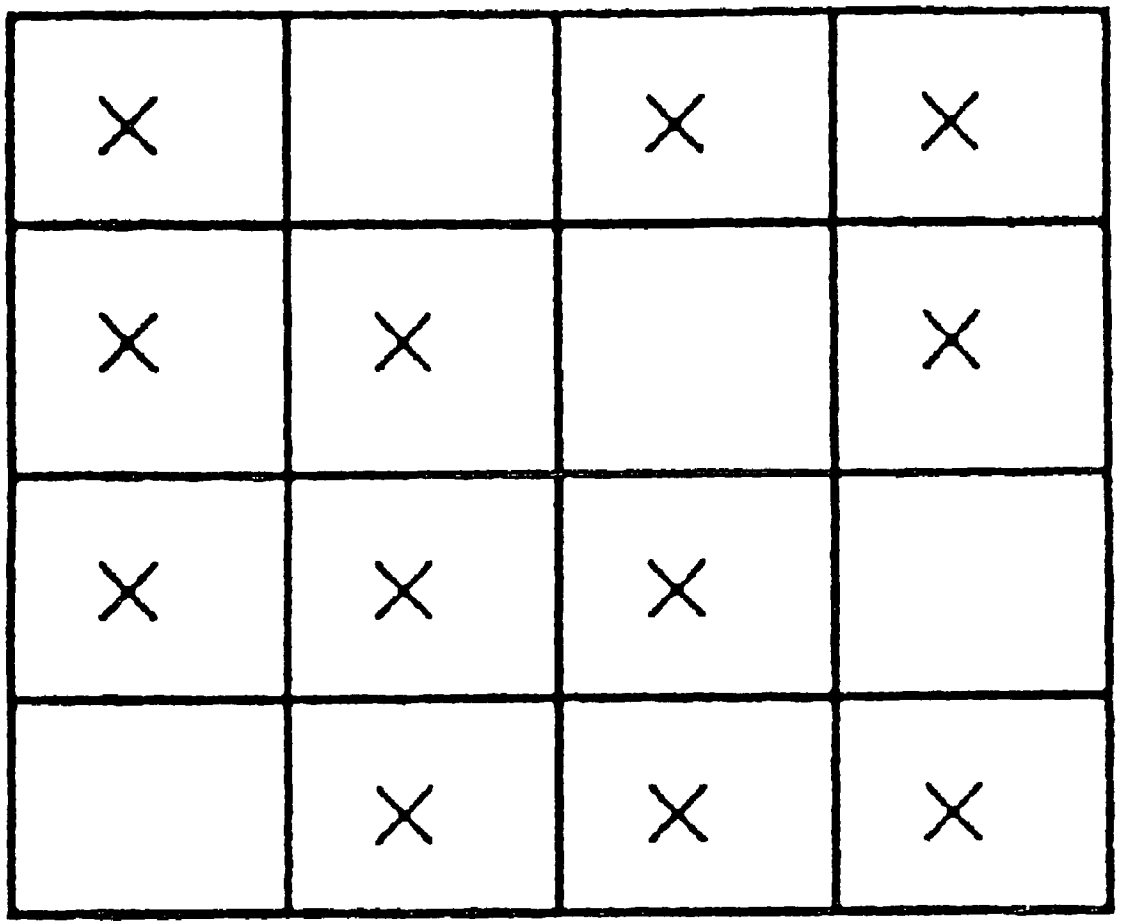
FIG. 1 depicts the structure of a pure cotton denim fabric possessing desirable moisture management properties, consistent with the present invention.

With reference to the drawings wherein like numerals represent like parts throughout the several figures, a method of manufacturing textiles and/or fabrics with moisture management properties in accordance with the present invention is generally designated by the numeral 10. The method 10 may include the steps of pretreatment, hydrophobicity modification, fabric structuring, wet finishing, washing, and functional treatment.

Pretreatment

Constituent fibers used in the construction of textiles and fabrics are often utilized as strands of fibers, in which the fibers are twisted or enjoined together to form yarn. The yarn in one embodiment of the invention is pretreated 12 in order to condition the yarn for subsequent processing. Prior to commencing pretreatment the yarn may be wound onto reels to facilitate handling and storage of the yarn during processing. One principle of the pretreatment 12 step is to improve the absorbency characteristics of the yarn. For example, cotton yarn can be treated with a solution which includes, for example, caustic soda, which is used at a concentration of about 5% (on weight of fiber/fabric (owf), sodium metasilicate, nonahydrate 2.5% (owf), sodium sulfite 2.5% (owf), anionic detergent 2.0 to 3.0% (owf) with a liquor ratio of about 30:1.

For pretreatment, the reeled yarn may be soaped in the pretreatment solution at a temperature of about 80° C. for a period of about 2 hours. Alternatively, the yarn can be soaped in the pretreatment solution at a temperature of about 99° C., for a period of about 1 hour. The reeled and soaped yarn is then removed from the pretreatment solution and washed/rinsed in fresh water repeatedly, for example, three times.

Hydrophobicity Modification

Hydrophobicity refers to the relative affinity, hydrophobicity/hydrophilicity, the fiber, textile, fabric or portions of the fiber, textile, fabric possess with regard to aqueous solutions. In one embodiment of the invention the hydrophobicity of the yarn is modified. This hydrophobicity modification 14 acts on the yarn such that it becomes more or less hydrophilic or hydrophobic. Numerous natural and/or synthetic yarns can be used to manufacture textiles or fabrics with desirable moisture management properties. Variations to the modification process may be designed and utilized in order to impart the desired hydrophilic or hydrophobic properties to the yarn depending of the types of fibers composing the yarn. However, one of the underlying principles of the hydrophobicity modification 14 is to modify the water absorbance properties of the yarn such that the properties meet the structural design requirement in the fabric structuring stage. The structural design requirement of the fabric structuring stage may require an originally hydrophobic yarn to be modified such that it becomes hydrophilic. For example, when wool yarns, which are typically hydrophobic, are specified for use in the fabrication, the wool yarn is hydrophilically modified. Other yarns, such as cotton, which are naturally hydrophilic, may require a hydrophobic modification to be performed.

Because of the desirable physical and economic properties associated with cotton yarns. These yarns are often employed in producing textiles and fabrics. However, cotton yarns readily absorb moisture due to cotton's hydrophilicity. To achieve a desirable moisture management property, the absorbent capacity of cotton yarn must often be reduced through use of, for example, a durable water repellence treatment. For instance, functional nano-particles and/or fluorochemicals may be applied to the yarn in one embodiment of the invention.

Several formulations of hydrophobicity modifying compositions may be used to reduce the absorbent capacity of yarns. For example, one formulation may included a fine powder of SiO2 having an about 40 nm to about 80 nm size at a concentration of about 2 g/L to about 5 g/L; a dispersing agent, such as fatty alcohol/ethytlene oxide condensate such as Matexil DN-VL, at a concentration of about 5 g/L; sodium polyphosphate at a concentration of about 5 g/L; fluorochemicals, such as WRS C35 from Advanced Chemicals, at a concentration of about 40 gi/L; Acetic acid (HAC) (98%) at a concentration of about 1 g/L.

A second, alternative, formulation may included a fine powder of SiO2 having an about 40 nm to about 80 nm size at a concentration of about 2 g/L to about 5 g/L; a dispersing agent, such as poly(acrylic acid), sodium salt-graft poly(ethylene oxide) with a molecular weight (MW) of about 4000, at a concentration of about 5 g/L; sodium polyphosphate at a concentration of about 5 g/L; fluorochemicals, such as WRS C35 from Advanced Chemicals, at a concentration of about 40 g/L; Acetic acid (HAC) (98%) a concentration of about 1 g/L.

A third illustrative example is a formulation which may included a fine powder of SiO2 having an about 40 nm to about 80 nm size at a concentration of about 2 g/L to about 5 g/L; a dispersing agent, such as poly(acrylic acid), sodium salt-graft poly(ethylene oxide) about MW 4000, at a concentration of about 5 g/L; sodium polyphosphate at a concentration of about 5 g/L; organofluorine compounds, like Oleophobol™ C from Ciba Chemicals, at a concentration of about 40 g/L; Acetic acid (HAC) (98%) a concentration of about 1 g/L.

The step of hydrophobicity modification 14 can be accomplished by exposing the reeled yarn to the hydrophobicity modifying formulation, for example, by dipping or submergence into the formulation. In one embodiment of the invention the weight of each package of the reeled yarn is about 200 grams. The reeled yarn is thoroughly saturated with the formulated nano suspension at ambient temperature for at least 2 minutes. The reeled yarn is then removed from the formulation and spin-dried using, for instance, a centrifugal machine. The reeled yarn is then dried in an oven at a temperature of about 80° C. to about 90° C. for a period of about 3 to about 4 hours.

Fabric Structuring

Figure 4:
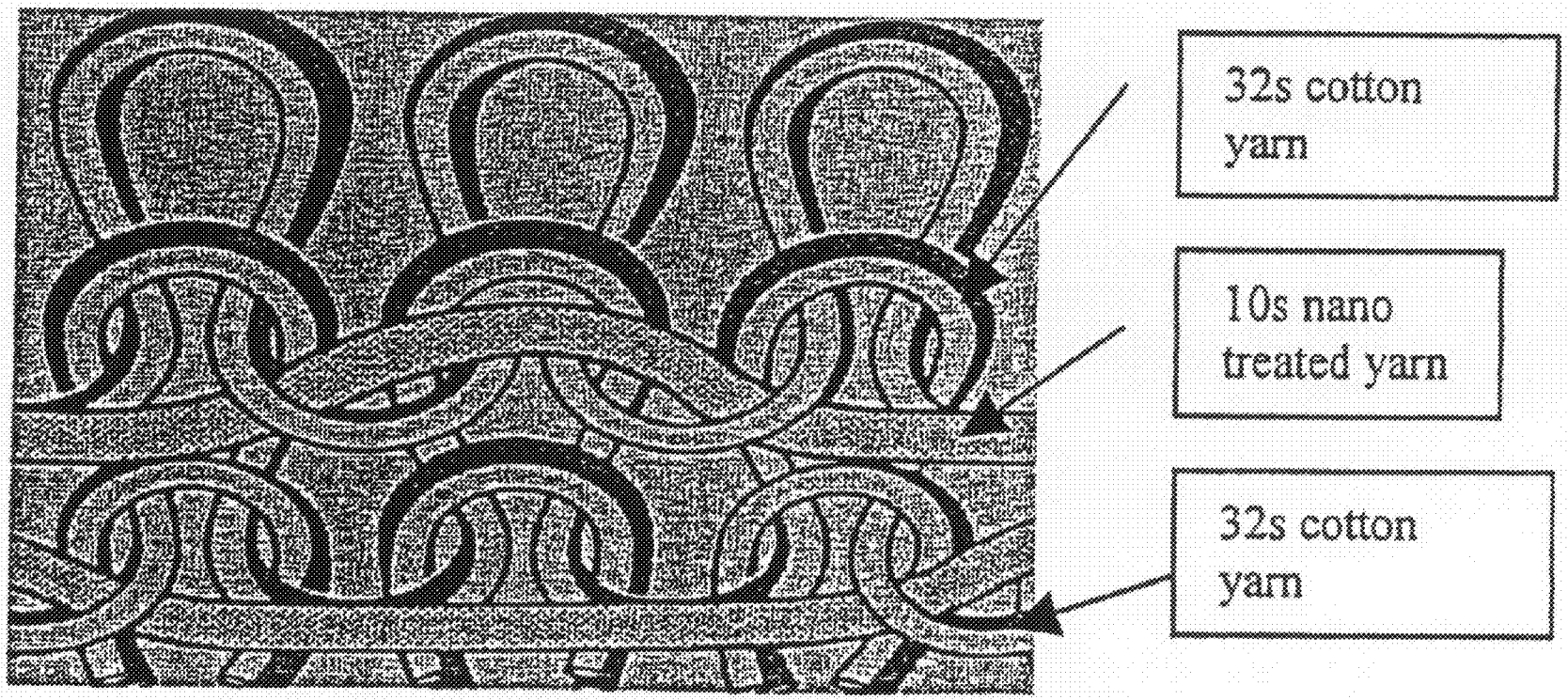
FIG. 4 is a depiction of a fabric structure consistent with the present invention.

Fabric structure design is based on, among other things, the principle of structuring 16 a fabric such that, at least, two distinct surfaces are formed. For example, a first fabric surface is formed which may be defined as a surface with a high proportion of hydrophobic areas or structure points and with a low proportion of hydrophilic areas or structure points. In a two sided fabric, having such a hydrophobic/hydrophilic structuring, the first side may be used next to the skin of a wearer. The second and opposite surface is formed which may be defined as a surface with a high proportion of hydrophilic areas or structure points and a low proportion of hydrophobic areas or structure points. An example of such fabric structuring is "Composite Textile Material", U.S. application Ser. No. 09/759,241, herein incorporated by reference, and IP-96A, "Woven fabric with moisture management properties". FIG. 4 shows an example of the structure of a pure cotton knitted fabric with desirable moisture management properties.

Wet Finishing

Prior to weaving, the yarn is often treated with sizing to protect it from damage during the weaving process. The sizing must, if present, then be removed by a desize treatment. Untreated woven cotton yarns may also benefit from wet finishing 18 in order to increase the wettability of the yarn. For example, a wet finishing formulation for woven pure cotton fiber can include, caustic soda at a concentration of about 3.0% (owf); sodium metasilicate, nonahydrate at a concentration of about 2.0% (owf); sodium sulfite at a concentration of about 2.0% (owf); and anionic detergent at a concentration of about 2.0 to 3.0% (owf).

To accomplish wet finishing 18, the textile or fabric is soaped in the wet finishing formulation at a temperature of about 80° C. to about 85° C. for a period of about 1 to about 1.5 hours. A liquor ratio of about 30:1 may be used. The liquor ratio is defined as the ratio of the liquor weight to the textile or fabric weight. In one embodiment of the invention, an anionic detergent can be used as a surfactant in the formulation. The use of an anionic detergent is especially preferred in an alkaline formulation system.

Washing

Following wet treatment the textile or fabric may be washed prior to any further processing. Washing may be accomplished in an industrial washing machine with a liquor ratio, by weight, of about 40:1 at a temperature of about 60° C. An anionic detergent is added to the washing bath at a concentration of about 2% (owf). The duration of washing procedure is about 20 to about 30 minutes, and the textile or fabric is then washed/rinsed with water several times. For instance, the rising may be with fresh water for a total of 4 times. The textile or fabric is removed from the rinse step and is spun to remove excess liquid by, for instance, a centrifugal machine.

Functional Treatment

The textile or fabric is then processed by a finishing or functional treatment 20 in order to increase the difference between the hydrophobic and hydrophilic properties in the structured textile or fabric. This functional treatment 20 is directed toward achieving or enhancing the desired level of moisture management performance. For example, the functional treatment 20 is carried out wherein a formulation is applied to the textile or fabric. One functional treatment formulation may include a fine powder of SiO2 having an about 40 nm to about 80 nm size at a concentration of about 4 g/L; an acrylate polymer, such as binder G-1 from Jitat company at a concentration of about 2.5 g/L; a dispersing agent, such as a fatty alcohol/ethytlene oxide condensate such as Matexil DN-VL, at a concentration of about 5 g/L; ethoxylate sulfate derivatives such as MIX 116 from Maxintel at a concentration of about 15 g/L.

Another example of a functional treatment formulation may included a fine powder of SiO2 having an about 40 nm to about 80 nm size at a concentration of about 4 g/L; an acrylate polymer, such as binder G-1 from Jitat company at a concentration of about 2.5 g/L; a dispersing agent, such as a fatty alcohol/ethytlene oxide condensate such as Matexil DN-VL, at a concentration of about 5 g/L; a fatty alcohol ethoxylate, polysiloxane sulpho-succinate such as from Aldrich chemicals at a concentration of about 8 g/L.

In preparing the functional treatment formulations above, the additives are mixed with water, for example, ultrasonically such that a well-dispersed suspension is formed. The textile or fabric is then padded through the formulation. An example of a weight addition for the functional treatment formulation to the textile or fabric may preferably be in the range of about 60% to about 70%. The textile or fabric is then dried at a temperature of about 80° C. for a period of about 10 minutes, and is then cured at a temperature of about 130° C. for a period of about 5 minutes.

Figure 2:
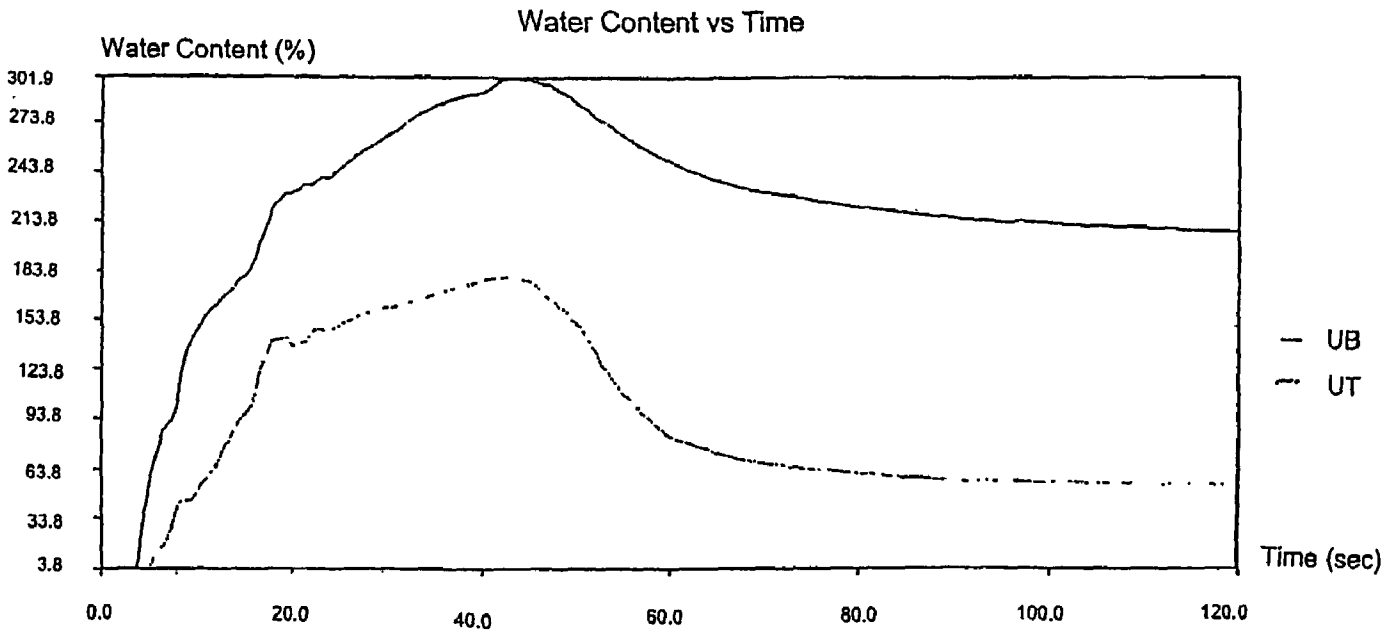
FIG. 2 is a graph and data table of measurement results associated with pure cotton denim fabric of the type shown in FIG. 1, consistent with the present invention.

An example of the structure of pure cotton woven fabric with desirable moisture management properties is shown in the FIG. 1. The construction of the fabric, referred to commonly as denim, in FIG. 1 has a warp of 20s 80 ends/inch, and a weft of 10s 64 end//inch. FIG. 2 shows the moisture measurement results of cotton denim fabric typical of the fabric with the structure shown in FIG. 1. The water content on the fabric outer surface (UB) is higher than the water content on the inner surface (UT). FIG. 2 clearly shows that moisture is transferring from the inner surface of the fabric to outer surface of the fabric. Such transferred moisture may then be evaporated into environment from this outer surface.

Figure 3:
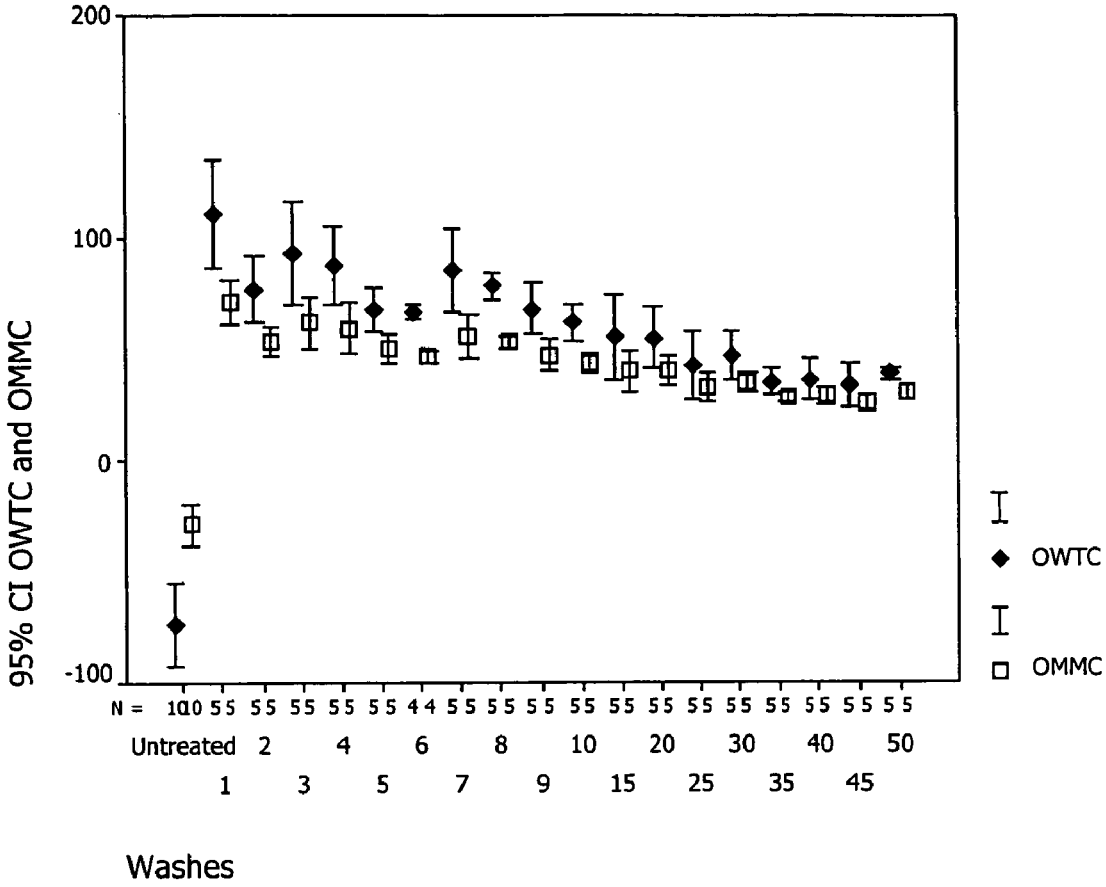
FIG. 3 is a graph of a fabric's one way transfer capacity and overall moisture management capacity data after each of 50 standard washes.

Untreated cotton fabric has a hydrophilic property and in a garment, the moisture is typically first introduced onto the inner surface by perspiration. Therefore, the water content value on the outer surface of an untreated cotton fabric will be equal to or less than the water content value on the inner surface. Hence, the value of one way transfer properties (OWTC) associated with untreated pure cotton fabric is about equal to or less than 0. OWTC and overall moisture management capacity (OMMC) of a fabric is shown in FIG. 3. OWTC and OMMC can be measured by a moisture management tester. It is well known that moisture management properties of textiles and fabrics may be quantitatively determined with moisture management tester such as is described in U.S. Pat. No. 6,499,338 which is incorporated by reference herein.

FIG. 3 shows measurement data after each of 50 standard washes. Compared with conventional untreated fabrics having substantially the same structure and content, for instance, those constructed of untreated pure cotton yarn, the present invention clearly exhibits desirable moisture management properties.

In one embodiment of the invention, the production of moisture management textiles or fabrics is accomplished by employing the pretreatment 12, hydrophobicity modification 14, fabric structuring 16, wet finishing 18, and functional treatment 20 steps as described above. The formulation used in the step of hydrophobicity modification 14 may be a fine powder of SiO2 having an about 40 nm to about 80 nm size at a concentration of about 2 g/L to about g/L; a dispersing agent, such as a fatty alcohol/ethytlene oxide condensate like Matexil DN-VL, at a concentration of about 5 g/L; sodium polyphosphate at a concentration of about 5 g/L; a fluorochemical, such as WRS C35 from Advanced Chemicals, at a concentration of about 40 g/L; Acetic acid (HAC) (98%) a concentration of about 1 g/L. The fibers are exposed to the formulation of hydrophobicity modifying compositions, for example, by dipping. The fibers are thoroughly saturated with the formulated nano-suspension at ambient temperature for at least 2 minutes to about 5 minutes. The fibers are then removed from the formulation and spin-dried using, for instance, a centrifugal machine. The fibers are then dried in an oven at a temperature of about 80° C. to about 90° C. for a period of about 3 to about 4 hours. In the functional treatment step 20, the formulation includes a fine powder of SiO2 having an about 40 nm to about 80 nm size at a concentration of about 4 g/L; an acrylate polymer, such as binder G-1 from Jitat company at a concentration of about 2.5 g/L; a dispersing agent, such as a fatty alcohol/ethytlene oxide condensate like Matexil DN-VL at a concentration of about 5 g/L; and or an ethoxylate sulfate derivative, such as MIX 116 from Maxintel at a concentration of about 15 g/L. The formulation additives above are mixed with water, for example, ultrasonically such that a well-dispersed suspension is formed. The textile or fabric is then padded through the functional treatment formulation. A weight addition of about 60% to about 70% is preferably made and the textile or fabric is then dried at a temperature of about 80° C. for a period of about 10 minutes, and cured at a temperature of about 130° C. for a period of about 5 minutes.

Figure 5:
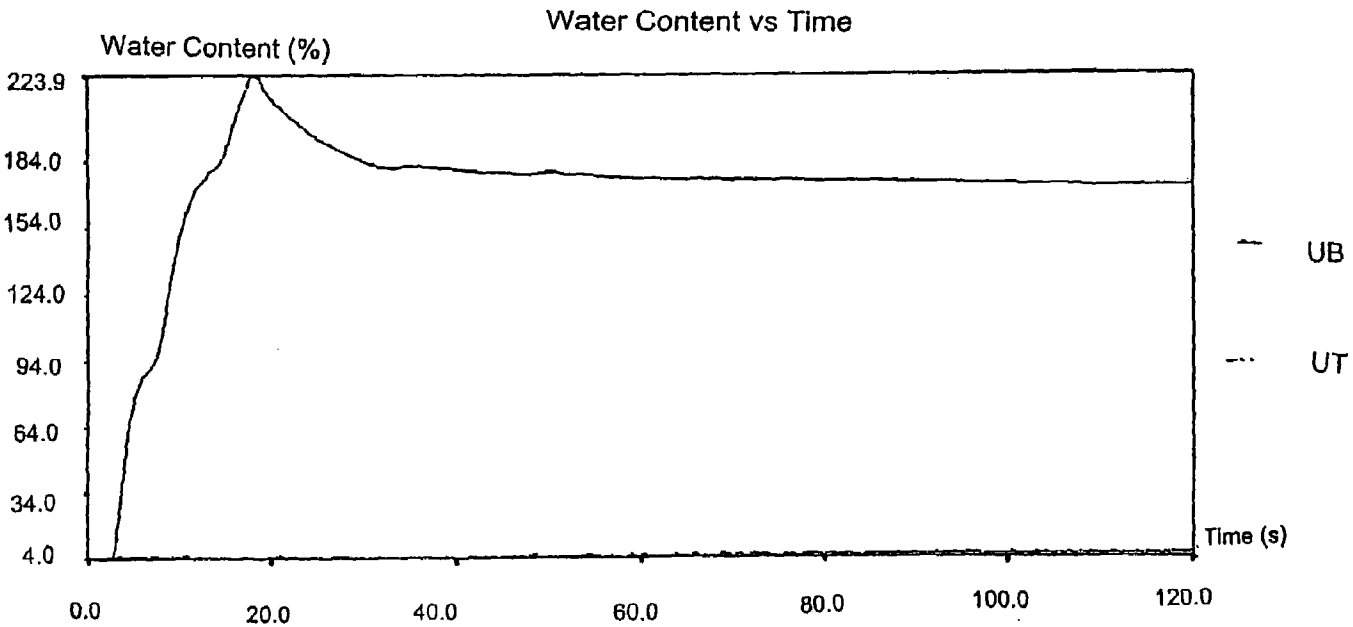
FIG. 5 is a graph and data table of measurement results associated with the fabric of FIG. 4.
Figure 6:
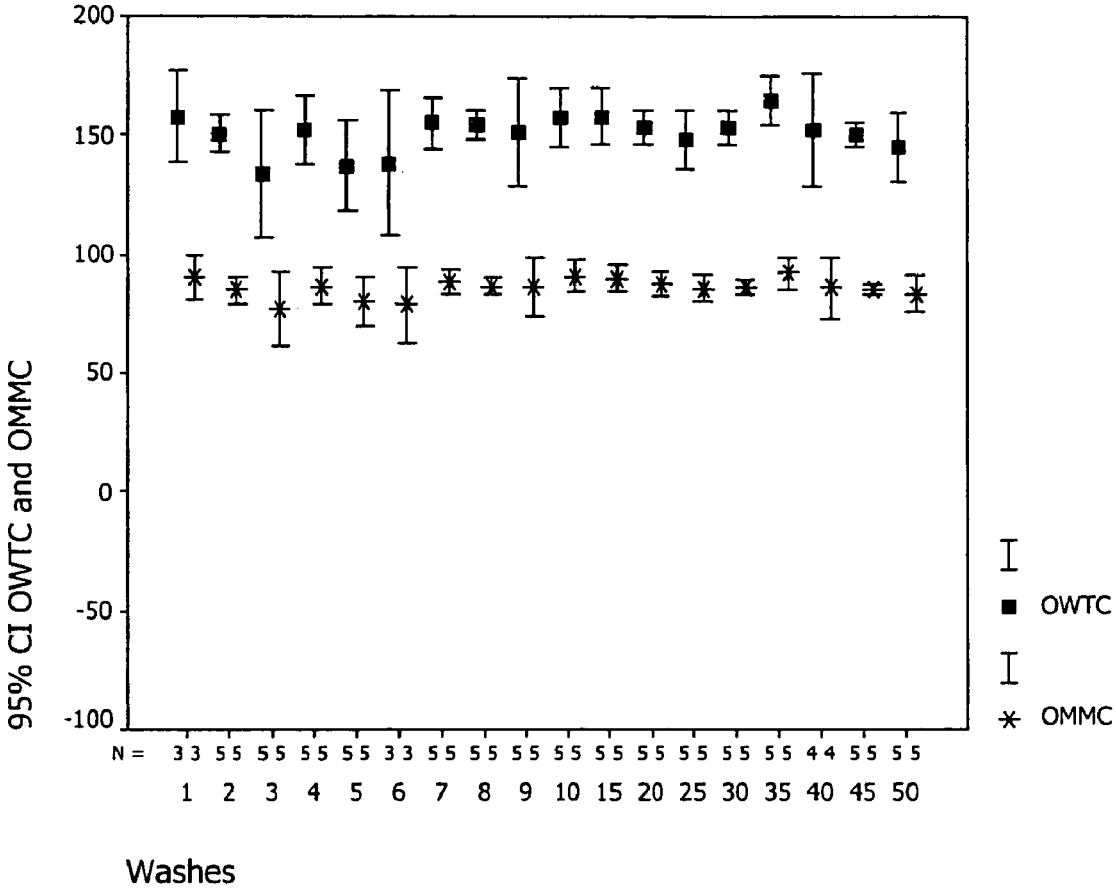
FIG. 6 is a graph of moisture measurement data associated with a fabric's one way transfer capacity and overall moisture management capacity after each of 50 times standard washes.
Figure 7:
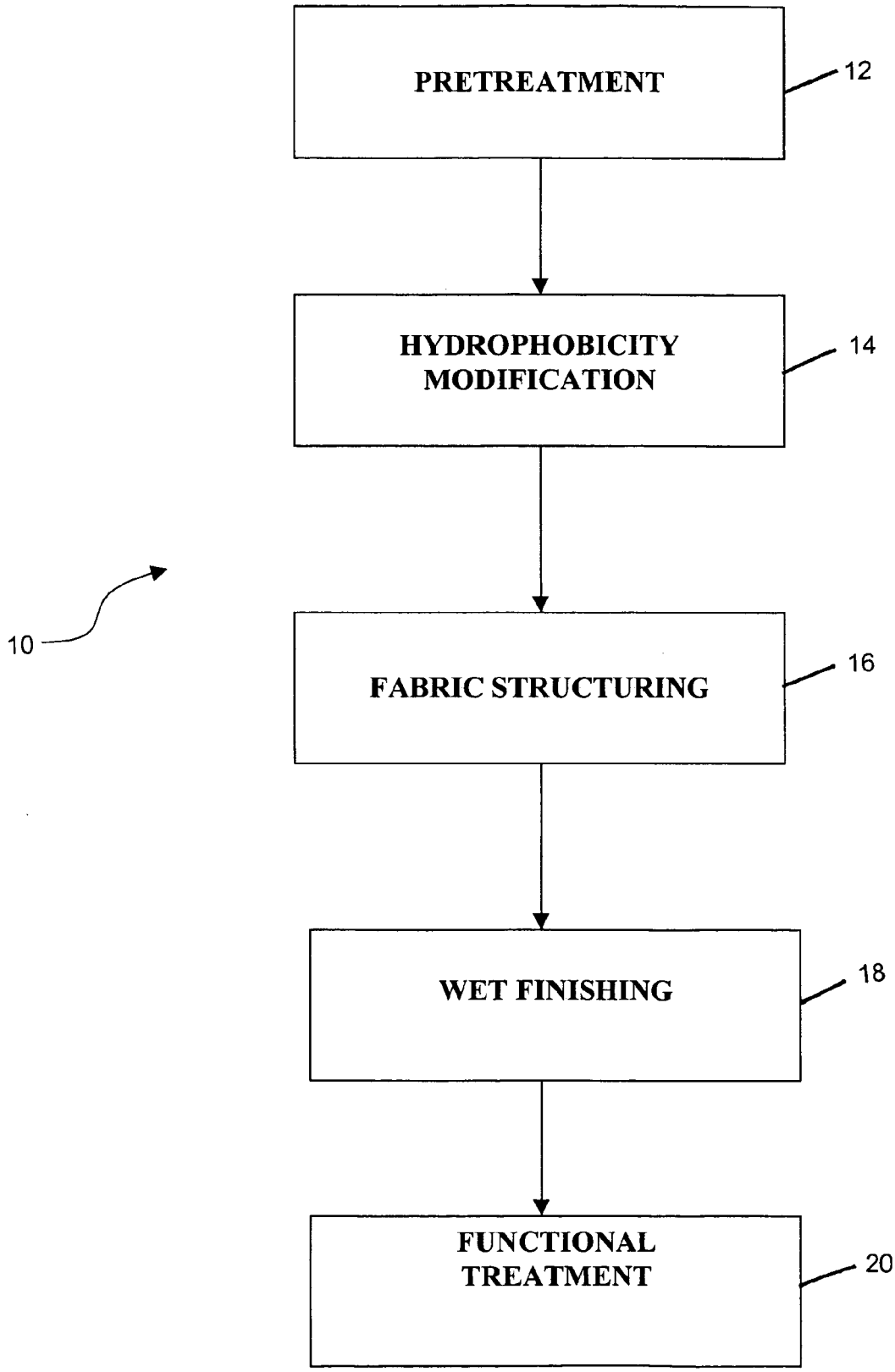
FIG. 7 is a flow chart of the process of producing a textile or fabric with desirable moisture management properties consistent with the present invention.

An example of the structure, as obtained in the fabric structuring step, of a moisture management treated pure cotton knitted fabric is shown in FIG. 4. Moisture measurement results for a fabric such as in FIG. 4 is shown in FIG. 5. The fabric's one way transfer properties after each of 50 washes is shown in FIG. 6.

The advantage of this invention is clear. It is now possible to manufacture pure cotton woven/knitting fabrics with desirable moisture management properties. Therefore, this invention can be widely used in functional clothing applications with an improved comfort perception during wearing, especially in sports wear, casual wear, uniform and personal protective clothing. Such a fabric process technique also can be used for products related to children, elderly, and disabled persons to improve their life quality.

It should be clear that the processing techniques for preparing moisture management textiles can include any typical yarn, including those yarns made from silk and synthetic fibers. One of the key principles is to modify the moisture properties of the yarn and determine the proportional distribution of hydrophobic and hydrophilic area points on textile's composite surfaces, which are created in fabric structuring of the fabric.

While the preferred embodiments have been shown to describe the invention, various modifications and substitutions may be made thereto without departing from the spirit and scope of the invention. Accordingly, it is to be understood that the present invention has been described by way of illustration and not limitation.

We claim:

1. A method of producing a moisture managing textile comprising the steps of:

altering an absorbency of strands of fibers, said altering including:

(a) improving the absorbency of the strands of fibers by exposing the strands of fibers at a liquor ratio of about 30:1 to an aqueous mixture of caustic soda 5% (owf), sodium metasilicate, nonahydrate 2.5% (owf), sodium sulfite 2.5% (owf), anionic detergent 2.0 to 3.0% (owf), said exposure being at about 80° C. to about 90° C. for a period of about 1 to about 2 hours; and (b) washing the strands of fibers with fresh water;

modifying the hydrophobicity of the strands of fibers;

assembling strands of fibers into a textile having a first side and a second side;

modifying the textile wetability; and increasing a differential between a hydrophobic property and a hydrophilic property present in the strands of fibers in the textile.

2. The method of producing a moisture managing textile of claim 1, wherein the step of modifying the hydrophobicity of the strands of fibers includes:

reducing the absorbency of the strands of fibers by saturating the strands of fibers, at ambient temperature, with an aqueous mixture of $SiO_2$ having a size of about 40 nm to about 80 nm at a concentration in the range of about 2 g/L to about 5 g/L, fatty alcohol/ethytlene oxide condensate at a concentration of about 5 g/L, sodium polyphosphate at a concentration of about 5 g/L, fluorochemical at about 40 g/L, and acetic acid (HAC) (98%) at a concentration of about 1 g/L;

removing excess hydrophobic modifying formulation from the fiber; and drying the fiber at about 80° C. to about 90° C. for about 3 to about 4 hours.

3. The method of producing a moisture managing textile of claim 1, wherein the step of modifying the hydrophobicity of the strands of fibers includes:

reducing the absorbency of the strands of fibers by saturating the strands of fibers, at ambient temperature, with an aqueous mixture of $SiO_2$ having a size of about 40 nm to about 80 nm at a concentration in the range of about 2 g/L to about 5 g/L, poly(acrylic acid), sodium salt-graft poly(ethylene oxide) having a molecular weight of 4000 at a concentration of about 3.5 g/L, sodium polyphosphate at a concentration of about 5 g/L, fluorochemical at about 40 g/L, and acetic acid (HAC) (98%) at a concentration of about 1 g/L;

removing excess hydrophobic modifying formulation from the fiber; and drying the fiber at about 80° C. to about 90° C. for about 3 to about 4 hours.

4. The method of producing a moisture managing textile of claim 1, wherein the step of modifying the hydrophobicity of the strands of fibers includes:

reducing the absorbency of the strands of fibers by saturating the strands of fibers, at ambient temperature, with an aqueous mixture of $SiO_2$ having a size of about 40 nm to about 80 nm at a concentration in the range of about 2 to about 5 g/L, poly(acrylic acid), sodium salt-graft poly (ethylene oxide) having a molecular weight of 4000 at a concentration of about 5 g/L, organofluorine compound at a concentration of about 40 g/L, and acetic acid (HAC) (98%) at a concentration of about 1 g/L;

removing excess hydrophobic modifying formulation from the fiber; and drying the fiber at about 80° C. to about 90° C. for about 3 to about 4 hours.

5. The method of producing a moisture managing textile of claim 1, wherein the step of assembling strands of fibers into a textile having a first side and a second side includes incorporating hydrophobic fibers in a greater proportion on the first side than on the second side of the textile and incorporating hydrophilic fibers in a greater proportion on the second side than on the first side of the textile.

6. The method of producing a moisture managing textile of claim 1, wherein the step of modifying the textile wetability includes the step of:

soaping the textile at a range of about 80° C. to about 85° C. for a period of time of about 1 to about 1.5 hours in a solution which includes caustic soda 3.0% (owf), sodium metasilicate nonahydrate 2.0% (owf), sodium sulfite 2.0% (owf), anionic detergent in the range of about 2.0% to about 3.0% (owf), said soaping being done at a liquor ratio of about 30:1.

7. The method of producing a moisture managing textile of claim 1, wherein the step of increasing a differential between a hydrophobic property and a hydrophilic property present in the strands of fibers in the textile includes: padding the textile through a suspension solution which includes $SiO_2$ having an about 40 nm to about 80 nm size, acrylate polymer at a concentration of about 2.5 g/L, fatty alcohol/ethytlene oxide condensate at a concentration of about 5 g/L, and ethoxylate sulfate derivative at a concentration of about 15 g/L such that an about 60% to about 70% weight addition results, drying the textile at about 80° C. for a period of about 10 minutes, and then curing the textile at about 130° C. for a period of about 5 minutes.

8. The method of producing a moisture managing textile of claim 1, wherein the step of increasing a differential between a hydrophobic property and a hydrophilic property present in the strands of fibers in the textile includes: padding the textile through a suspension solution which includes $SiO_2$ having an about 40 to 80 nm size at a concentration of about 4 g/L, acrylate polymer 2.5 g/L, fatty alcohol/ethytlene oxide condensate at a concentration of about 5 g/L, and fatty alcohol ethoxylate, polysiloxane sulpho-succinate at a concentration of about 8 g/L such that an about 60% to about 70% weight addition results, drying the textile at about 80° C. for a period of about 10 minutes, and then curing the textile at about 130° C. for a period of about 5 minutes.

9. A method of producing moisture management textiles comprising:

treating fibers with conditioning formulations, said treating including:

preparing the conditioning formulation from, caustic soda 5% (owf), sodium metasilicate, nonahydrate 2.5% (owf), sodium sulfite 2.5% (owf), and anionic detergent 2.0 to 3.0% (owf);

a liquor ratio 30:1;

exposing the fiber at a liquor ratio of about 30:1 to the conditioning formulation by soaping at either about 80° C. for about 2 hours or about 99° C. for about 1 hour; and washing the fiber with fresh water to yield a treated fiber;

modifying the hydrophobic properties of the fibers;

incorporating the modified fibers into a composite structure;

desizing fibers of the composite structure if necessary; and applying a functional treatment formulation to the composite structure.

10. The method of producing moisture management textiles of claim 9, wherein the step of modifying the hydrophobic properties includes:

preparing the hydrophobic modifying formulation from, a fine powder of $SiO_2$ having a size of about 40 nm to about 80 nm at a concentration ranging from about 2 g/L to about 5 g/L, a fatty alcohol/ethytlene oxide condensate at a concentration of about 5 g/L, sodium polyphosphate at a concentration of about 5 g/L, fluorochemical at a concentration of about 40 g/L, and acetic acid (HAC) (98%) at a concentration of about 1 g/L;

saturating the fiber thoroughly with the hydrophobic modifying formulation at an ambient temperature for a period of at least 2 to 5 minutes;

removing excess hydrophobic modifying formulation from the fiber; and drying the fiber at about 80° C. to about 90° C. for about 3 to about 4 hours.

11. The method of producing moisture management textiles of claim 9, wherein the step of modifying the hydrophobic properties includes:

preparing the hydrophobic modifying formulation from, a fine powder of $SiO_2$ having a size of about 40 nm to about 80 nm at a concentration ranging from about 2 g/L to about 5 g/L, poly(acrylic acid), sodium salt-graft poly(ethylene oxide) having a molecular weight of 4000 at a concentration of about 3.5 g/L, sodium polyphosphate at a concentration of about 5 g/L, fluorochemical at a concentration of about 40 g/L, and acetic acid (HAC) (98%) at a concentration of about 1 g/L;

saturating the fiber thoroughly with the hydrophobic modifying formulation at ambient temperature for a period of at least 2 to 5 minutes;

removing excess hydrophobic modifying formulation from the fiber; and drying the fiber at about 80° C. to about 90° C. for about 3 to about 4 hours.

12. The method of producing moisture management textiles of claim 9, wherein the step of modifying the hydrophobic properties includes:

preparing the hydrophobic modifying formulation from, a fine powder of $SiO_2$ having a size of about 40 nm to about 80 nm at a concentration ranging from about 2 g/L to about 5 g/L, poly(acrylic acid), sodium salt-graft poly(ethylene oxide) having a molecular weight of 4000 at a concentration of about 5 g/L, Organofluorine compound at a concentration of about 40 g/L, and acetic acid (HAC) (98%) at a concentration of about 1 g/L;

saturating the fiber thoroughly with the hydrophobic modifying formulation at ambient temperature for at least 2 to about 5 minutes;

removing excess hydrophobic modifying formulation from the fiber; and drying the fiber at about 80° C. to about 90° C. for about 3 to about 4 hours.

13. The method of producing moisture management textiles of claim 9, wherein the step of desizing the fibers of the composite structure if necessary includes:

preparing the desizing formulation from caustic soda 3.0% (owf), sodium metasilicate, nonahydrate 2.0% (owf), sodium sulfite 2.0% (owf), anionic detergent in a range of about 2.0 to about 3.0% (owf);

soaping the composite structure in the desizing formulation at about 80° C. to about 80° C. for about 1 to about 1.5 hours at a liquor ratio of 30:1;

washing, in water, the composite structure at a liquor ratio of 40:1 at a temperature of 60° C., said water having 2% (owf) anionic detergent for a period of about 20 to about 30 minutes;

rinsing the composite structure in fresh water; and removing excess liquid from the composite structure.

14. The method of producing moisture management textiles of claim 9, wherein said composite structure has an inner surface and an outer surface, said inner surface having a high proportion of hydrophobic areas and a low proportion of hydrophilic areas, said outer surface having a high proportion of hydrophilic areas and a low proportion of hydrophobic areas.

15. The method of producing moisture management textiles of claim 9, wherein the functional treatment includes:

a fine powder of $SiO_2$ having a size of about 40 nm to about 80 nm size at a concentration of about 4 g/L, acrylate polymer at a concentration of about 2.5 g/L, fatty alcohol/ethytlene oxide condensate at a concentration of about 5 g/L, and ethoxylate sulfate derivative at a concentration of about 15 g/L;

mixing the functional treatment to produce a suspension;

padding through the suspension to result in a weight addition of about 60% to about 70%; and drying the composite structure at about 80° C. for about 10 minutes, and curing at about 130° C. for about 5 minutes.

16. The method of producing moisture management textiles of claim 9, wherein the step of applying the functional treatment includes:

preparing the functional treatment formulation having, a fine powder of $SiO_2$ having a size of about 40 nm to about 80 nm size at a concentration of about 4 g/L, acrylate polymer at a concentration of about 2.5 g/L, fatty alcohol/ethytlene oxide condensate at a concentration of about 5 g/L, and fatty alcohol ethoxylate, polysiloxane sulpho-succinate at a concentration of about 8 g/L;

mixing the functional treatment to produce a suspension;

padding through the suspension to result in a weight addition in the range of about 60% to about 70%; and drying the composite structure at about 80° C. for about 10 minutes, and curing at about 130° C. for about 5 minutes.

* * * * *

UNITED STATES PATENT AND TRADEMARK OFFICE

CERTIFICATE OF CORRECTION

PATENT NO. : 7,407,514 B2
APPLICATION NO. : 11/050509
DATED : August 5, 2008
INVENTOR(S) : Li et al.

It is certified that error appears in the above-identified patent and that said Letters Patent is hereby corrected as shown below:

Column 10:

Line 19, delete "at about 80°C. to about 80°C."
and substitute --at about 80°C. to about 85°C.--

Signed and Sealed this

Twentieth Day of January, 2009

JON W. DUDAS
*Director of the United States Patent and Trademark Office*